US005388693A

United States Patent [19]

Ceraudo

[11] Patent Number: 5,388,693

[45] Date of Patent: Feb. 14, 1995

[54] BOX FOR STAPLES COMBINED IN STRIPS

[75] Inventor: Rosario Ceraudo, Recloses, France

[73] Assignee: Les Applications Rationnelles S.A., Vernoil, France

[21] Appl. No.: 122,976

[22] Filed: Sep. 17, 1993

[30] Foreign Application Priority Data

Sep. 18, 1992 [FR] France ..... 92 11168

[51] Int. Cl.[6] ..... B65D 85/24; B65G 59/00

[52] U.S. Cl. ..... 206/340; 221/279

[58] Field of Search ..... 206/340, 338; 221/229, 221/197, 198

[56] References Cited

U.S. PATENT DOCUMENTS

| | | | |
|---|---|---|---|
| 2,837,258 | 6/1958 | Williams | 221/279 X |
| 2,896,820 | 7/1959 | Clark et al. | 221/279 X |
| 3,254,398 | 6/1966 | Macondray et al. | 206/338 X |
| 4,379,514 | 4/1983 | Joffe | 221/279 |
| 4,687,098 | 8/1987 | Ebihara | 206/340 |

FOREIGN PATENT DOCUMENTS

| | | | |
|---|---|---|---|
| 0095581 | 4/1990 | Japan | 206/340 |

*Primary Examiner*—Bryon P. Gehman

*Attorney, Agent, or Firm*—Wolf, Greenfield & Sacks

[57] ABSTRACT

A box for individually dispensing staple strips. The strips are first loaded into a central magazine. A spring activated pusher on one side of the box urges the strips toward the other side. On the other side is positioned a spring loaded ejector device sized and shaped to receive one strip of staples. The ejector device moves in the plane normal to the pusher's motion. The ejector device raises the staple stack toward a window in the box thereby enabling the user to remove the stack.

7 Claims, 7 Drawing Sheets

BOX FOR STAPLES COMBINED IN STRIPS

The present invention relates to a box for staples combined in strips, for supplying a stapler.

At present, staples are distributed in cardboard boxes made of one or two parts; in optimum cases, the box consists of a sleeve with a rectangular section receiving a box part in the form of a drawer containing the staples. This embodiment is intended in particular for staples for office staplers. In other cases, the staples are placed in single-part boxes.

In both cases, in order to gain space, the strips of staples consisting of juxtaposed staples, held together by a film of varnish, are generally combined head-to-tail in twos, forming a double strip. Thus the double strips have a "closed" rectangular section.

By convention, in the remainder of the description, the term "strip" will be used to designate both single and double strips.

One of the principal disadvantages of packaging staples in boxes is that, when a few strips have been removed, the strips are relatively free in the packaging; they move into an oblique position and can break, particularly if half-full boxes fall or are transported from one workplace to another.

The small broken strips are frequently useless. Numerous staplers comprise loaders which can accommodate two or more strips. When the stapler reaches the end of a strip, the last or penultimate staple is no longer held in place correctly under the stapler striker device which often risks driving in this staple incorrectly, expelling the last two staples simultaneously or even deforming the staple in its guide path inside the stapler and blocking the latter. A relatively awkward operation is then required for extracting the deformed staple and continuing the work.

Although these operating incidents are not very significant when it is a matter of inserting a few staples, for a do-it-yourself job, for example, they are extremely disruptive for professional jobs, for example those of an upholsterer who is interrupted whilst securing a fabric panel.

In addition, for professionals, since boxes of staples are handled frequently, placed on chairs with folding steps or the like while the job is in progress, the boxes fall more frequently, the strips break, etc., which increases the above-mentioned disadvantages.

The object of the present invention is to provide packaging for strips of staples enabling the strips to be packaged such that they are protected and the presentation and distribution of the strips to be facilitated and distributed irrespective of the size of the staples.

To this end, the invention relates to a box, characterised in that it comprises:

a) a lower portion having:

a magazine forming a channel receiving the strips juxtaposed parallel to one another in a stack, transversely to the longitudinal direction of the magazine delimited by lateral guides and by a base, and having, at one end, a housing for a pusher device and, at the other end, a housing for an ejector device;

the stack of strips advancing progressively towards the ejector device housing as the strips are removed;

fastening means;

b) a cover:

covering the lower portion, its magazine and its housings;

this cover comprising a window in front of the ejector device housing;

this window forming a means for guiding and retaining the ejector device;

fastening means for cooperating with the fastening means of the lower portion;

an ejector device;

in the form of a drawer, open towards the strip magazine and towards the front face of the cover so as to constitute a housing for accommodating a double strip;

this drawer having guide means cooperating with the guide means of the lower portion and of the cover, being movable between an inserted position and an outlet position, the inserted retracted position enabling the double strip of the end of the stack to arrive in the drawer housing;

a spring pushing the ejector device from its inserted position towards its outlet position;

d) a pusher device provided with a spring which bears on the lower portion and pushes the stack of strips of the magazine parallel to one another, towards the outlet housing against and in the ejector device.

The advantage of this box is that it has an extremely simple structure, consists of a very small number of parts, and is very easy to fill when it is assembled. The constituent parts are made using the same moulds as the staples. The only adaptations necessary concern the lower portion and the ejector device; the thickness of the base of the strip magazine is to be adapted by a suitable wedge placed in the mould; a similar device allows the portion of the mould of the ejector device for the housing to be adapted.

The staple box is particularly practical to use; when the tamperproof plate has been removed, the ejector device removes the strip from the end of the stack and presents it outside the box which makes it easier to grip. The other strips in the stack continue to be held parallel securely against one another, the stack pushed by the pusher device bearing on the ejector device, which prevents any of the strips breaking. Handling of the box is easy and does not disadvantage the strips; it can even be easily attached to a belt loop on work clothes.

In addition, this box makes it easier to identify the staples and staplers, preventing customers from making incorrect purchases.

In the following, the present invention will be described in greater detail with reference to one embodiment of a box of staples shown schematically in the attached drawings, in which:

FIG. 7B is a side view in section of the pusher device and of its springs;

FIG. 7C is a plan view partially in section of the pusher device and of its springs;

Figure 1:
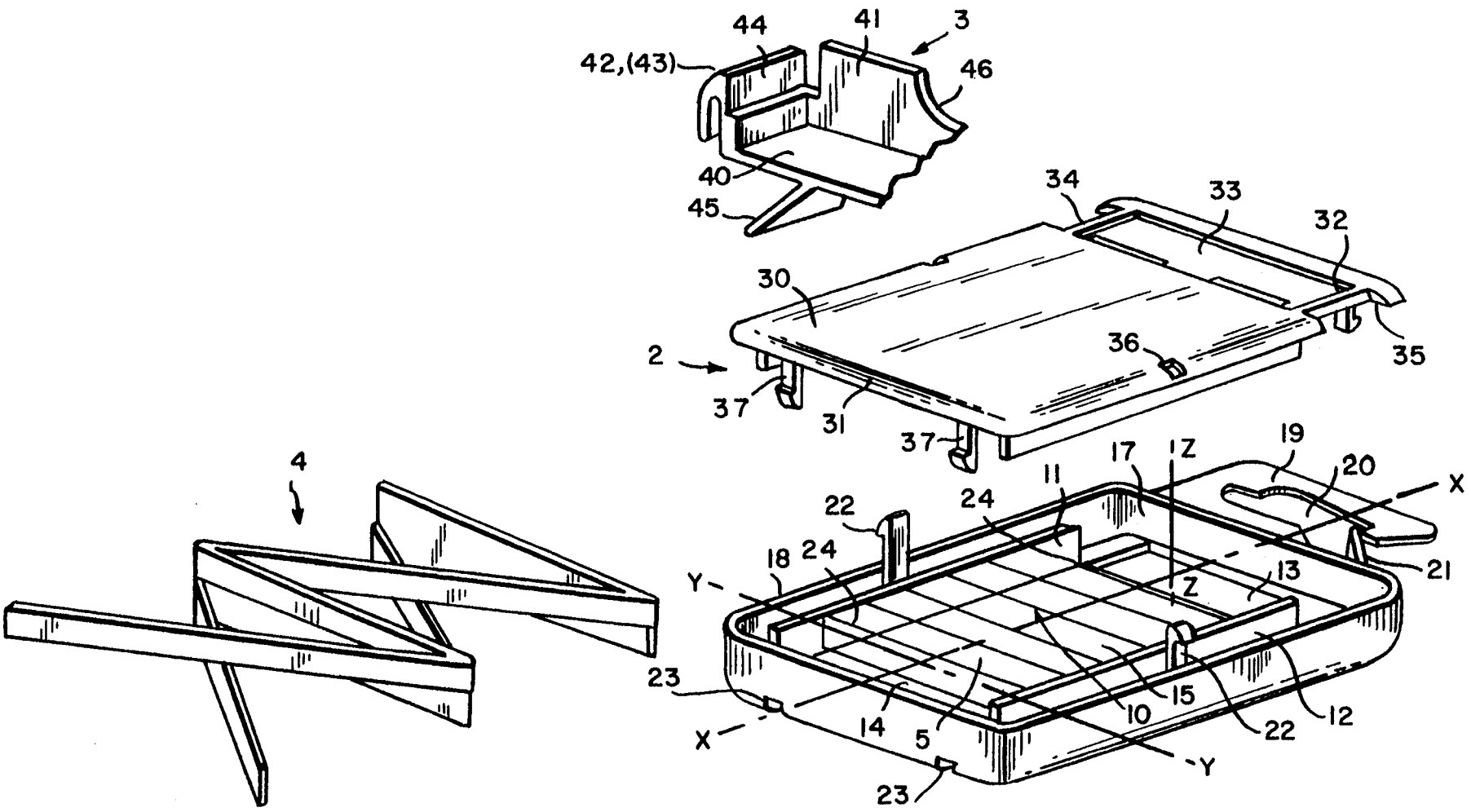
FIG. 1 shows an exploded view of the box of staples.

According to FIG. 1, the staple box consists of a lower portion 1, a cover 2, an ejector device 3 and a pusher device 4.

The lower portion 1 comprises a magazine 10 in the form of a channel corresponding to the housing of the staple strips 5 disposed transversely to the longitudinal direction XX of the magazine 10 or of the lower portion 1.

This magazine 10 is delimited on either side by a lateral guide 11, 12 defining the width of the magazine relatively precisely.

Figure 2C:
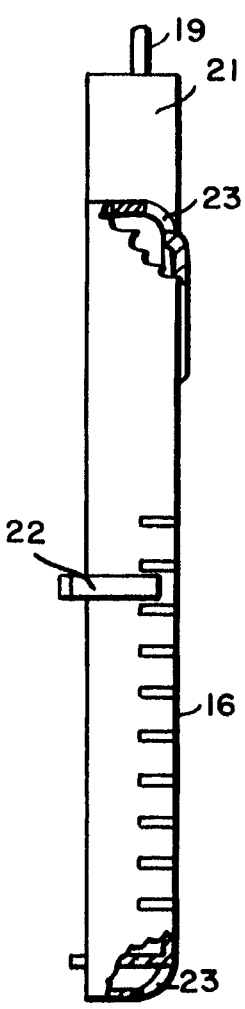
FIGS. 2A–2D show respectively a plan view, a bottom view, a side view and a side view in section of the lower portion of the box.
Figure 2B:
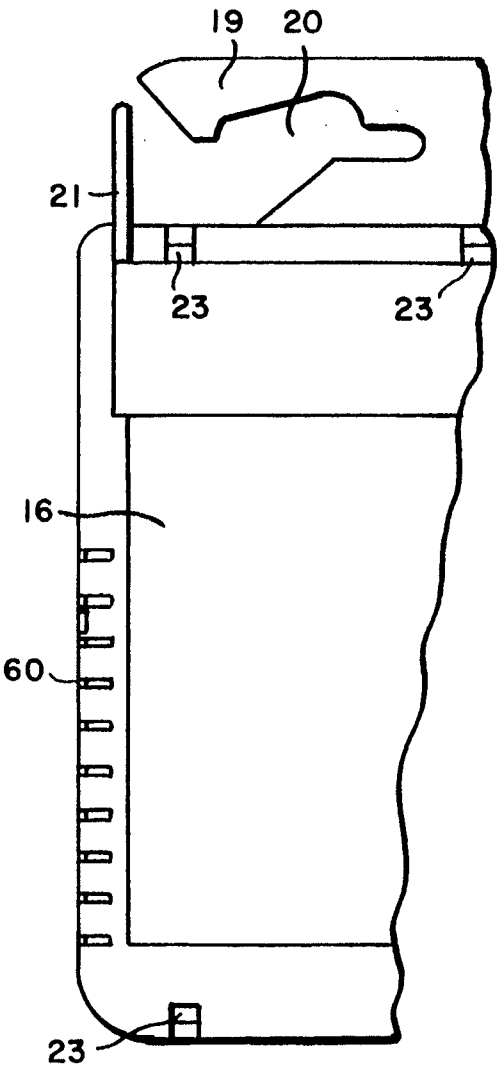
Figure 9A:
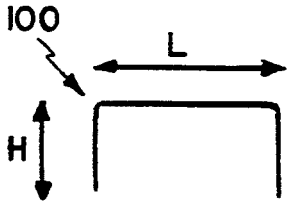
FIGS. 9A–9C are schematic views of a staple and of strips used to identify the dimensions mentioned in the description.

The magazine 10 is likewise defined by a base 15 which is generally thicker than the lower face 16 (FIG. 2C) of the lower portion 1 and is selected according to the width L of the staples (FIG. 9A).

In its upper portion the magazine 10 is delimited by the cover 2.

This channel-like magazine 10 is open at both ends; at one of its ends or at the first end, it opens into a housing 13 accommodating the ejector device 3 and, at the other or second end, it opens into a housing 14 accommodating the pusher device 4.

The housing 13 for the ejector device 3 is likewise delimited by a precisely positioned front wall 17 acting as a guide for the ejector device 3 which can move in the direction ZZ perpendicular to the plane of the lower portion 1 (i.e. perpendicular to the direction XX and to the transverse direction YY).

The lower portion 1 comprises an outer edge 18 which surrounds the lower face 16 and provides it with its outer contour. This edge 18 is generally separate from the guides (at least in the embodiment shown and in the preferred embodiments) such that it does not impose the constraints concerning precision, imposed in particular on the lateral guides 11, 12, the base 15, the front wall 17 of the housing 13, etc., on the mould assembly used for manufacturing the lower portion.

At its front end, the lower portion 1 bears a lug 19 with a securing aperture 20 to enable the box to be fastened to shelving or standardised display devices.

This aperture 20 is open transversely, and the opening is closed by an integral snap hook 21. This aperture enables the box to be fastened, for example, to a belt loop for users, for example upholsterers, who need to keep the staples on their person.

The edge 18 of the lower face 16 also comprises fastening means such as lugs 22 and fastening apertures 23 for cooperating with similar means provided on the cover 2.

The cover 2 covering the lower portion 1, the magazine 10 and the housings 13, 14 is a relatively flat part (the entire thickness of the box is shown by the lower portion 1 with its lateral guides 11, 12 and its peripheral edge 18). The cover 2 consists of an upper face 30 with a lateral edge 31 of reduced dimensions, as stated above. The upper face 30 occupies the greatest part of the cover 2. However, at the front, perpendicular to the housing 13, the cover comprises a window 32 initially occupied by a tamperproof plate 33, which holds the ejector device 3 in the pushed-in position and prevents the staple strips 5 being extracted. In order to extract the staple strips, it is sufficient to remove the plate 33. The ejector device 3 is thus released and can emerge from its housing whilst being guided by the edge of the window 32 in the cover 2. This guiding process is completed by lateral cut-outs 34, 35 through which the lateral lugs of the ejector device 3 pass.

On its edge 31, the cover comprises additional fastening means 36, 37 consisting of lugs and housings in positions similar to the corresponding means provided on the lower portion 1.

The ejector device 3 is a part in the form of a drawer, which is movable in the direction ZZ between an inserted position, i.e. bearing against the base of the housing 13 in the lower portion 1 and an outlet position, in relief relative to the cover 2 in the window 32 such that it enables the strip thus removed from the stack 24 of the strips in the magazine 10 to be manually retracted.

The ejector device 3 comprises a housing 40, open in the direction XX to accommodate the staple strip located at the end of the stack 37 in the magazine 1; this stack 37 is pushed by the pusher device 4. This housing 40 is likewise open in the direction ZZ to enable the strips 5 to be removed.

The ejector device 3 comprises a front partition 41 and lugs 42, 43 with a guide surface 44. The ejector device 3 is guided in the window 32 by its front 41 against the wall 16 of the casing and the walls 44 of the lugs 42, 43 bear against the corresponding face of the cut-outs 34, 35.

The ejector device 3 also comprises a spring 45 which pushes it towards the outlet position.

When the tamperproof plate 33 has been removed, the ejector device 3 moves into its outlet position which is its normal position. It is only when the lugs 42, 43 are pushed manually that the ejector device 3 can be urged into its inserted position. When the ejector device reaches the end of this movement, its housing 40 is then below the base 15 of the magazine 10 such that the strip, which is at the front of the stack 15 in the magazine 10, can slide into the housing 40. The length of this housing in the direction XX corresponds exactly with the height H of a strip (FIG. 9A). Under the effect of its spring 45, the ejector device 3 can then move into the outlet position and present the strip. The extraction of this strip from the housing 40 is facilitated by the cut-out 46 enabling it to be gripped.

As the strips are generally double, the user extracts the double strip from the housing 40 but can return the second (single) strip thereto if it is not required at that moment.

In accordance with the invention, the various parts constituting the box, i.e. the lower portion 1, the cover 2, the ejector device 3 and the pusher device 4, are preferably each made in one part from synthetic material, by injection.

This method of producing the various parts allows extremely simple manufacture once the moulds have been produced. This reduces the cost of the boxes, rendering it comparable to that of current boxes made of cardboard.

In addition, the moulds can be used for manufacturing boxes intended for different types of staples. In fact (FIG. 9A), a staple is a U-shaped part with a rectangular section having a width L corresponding to the length of the crosspiece and a height H corresponding to the length of the two branches. The width and height differ from one staple (and stapler) manufacturer to another; the height depends in particular on the nature of the materials receiving the staples.

It is possible to have staples of different heights for a given width.

Since the staple strips are to be housed in a magazine with relatively precise dimensions, both to avoid their moving in the magazine such that they cannot move obliquely or become jammed, the spacing between the guide surfaces 11, 12 of the magazine 10 must be relatively precise. This is possible by virtue of the fact that the parts of the mould for these lateral surfaces 11, 12 are produced independently of the outer shape of the lower portion 1 of the box. A further requirement is that of the width of the magazine 10 corresponds to the width of the staples (or of the staple strips, this width being measured in the direction YY). In order to adapt to the different widths L, it is sufficient to place parts of different thicknesses, forming the base, in the mould (not illustrated).

Thus, the basic mould for the lower portion 1 does not comprise a wedge for the base 15 of the magazine 10. This corresponds to the manufacture of a lower portion 1 intended for staples having the greatest width L. In order to adapt this mould to staples of different widths, wedges corresponding to the thickness of the base 15 to be produced are placed in the mould.

An adaptation of a substantially similar type is performed for the housing 40 of the ejector device 3, in order to adapt the latter to the height H of the staples (the height is measured in the direction XX).

Starting from the constituent components of a casing, the staples are packaged in an extremely simple manner. The staple strips are placed in a magazine 10 in a suitable lower portion 1. The ejector device 3 and the pusher device 4 are then put in place; for the latter device, the spring is compressed by the wedging of the pusher device 4 in its housing 14 such that it does not bear on the stack 24 of strips 5. The cover 2 is positioned by being fastened to the lower portion 1; the spring 45 of the ejector device 3 is compressed as a result of the cover 2 being pushed down.

When the box has been closed, in order to release the pusher device, it is sufficient to shake the box and thus release the pusher device from its housing 14, such that it can bear on the stack 24.

FIGS. 2A–2D show in a more detailed manner the shape of the lower portion 1, in particular the outer shape, i.e. the edge 18 of the lower portion 1. In addition, the snap hook 21 is shown in the position in which it is released from the mould. The snap hook 21 is released from the nose of the aperture 20 in the lug 19; in order for it to be able to fulfil its role as a snap hook, it is sufficient for it to be passed, by resilient deformation, under the nose 20A (position 21' shown in dashed lines).

On the exterior, the lower portion comprises small grooves 60, improving the shape of the lower portion 1 and preventing the box sliding when it is held in the hand.

Figure 2A:
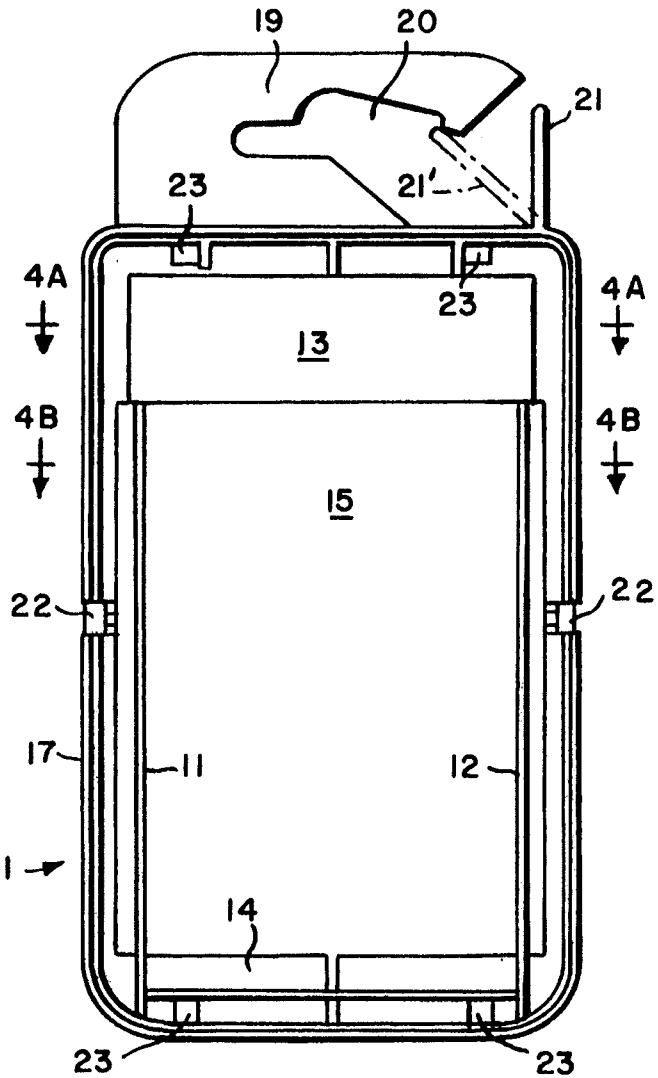
Figure 2D:
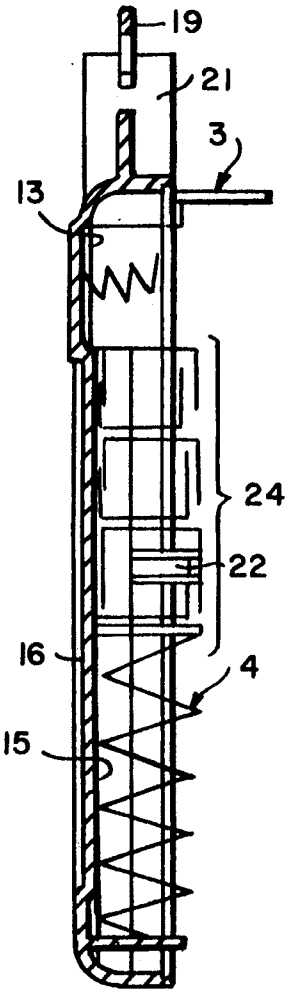

FIG. 2A shows that the base 15 comprises reference letters B.E. corresponding to a certain type of staple. These reference letters are applied when the lower portion 1 is injected; they identify the base 15 according to its thickness selected as a function of the width L of the staples.

The reference letters are useful for loading the magazine 10 with the strips.

Figure 3C:
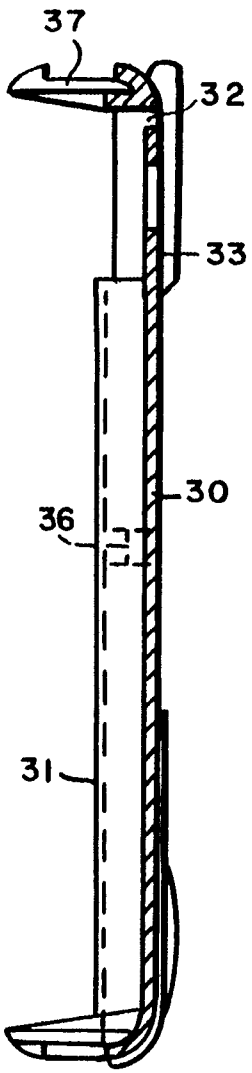
FIGS. 3A–3C show respectively a plan view, a bottom view and a view in longitudinal section of the box cover.
Figure 3A:
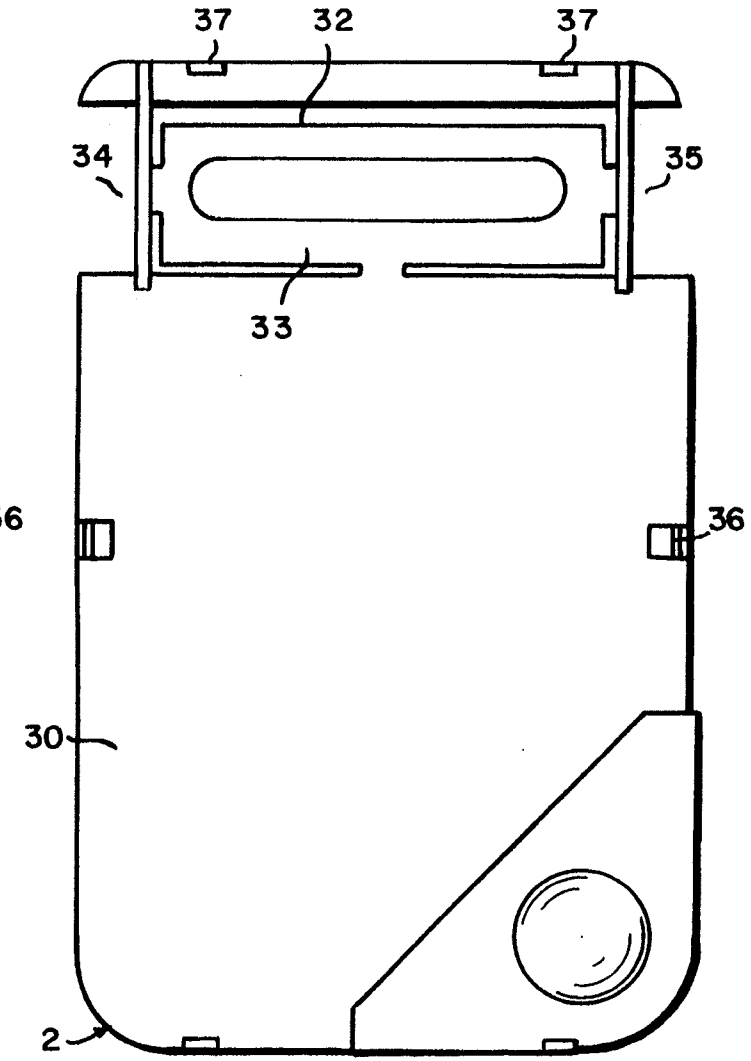
Figure 3B:
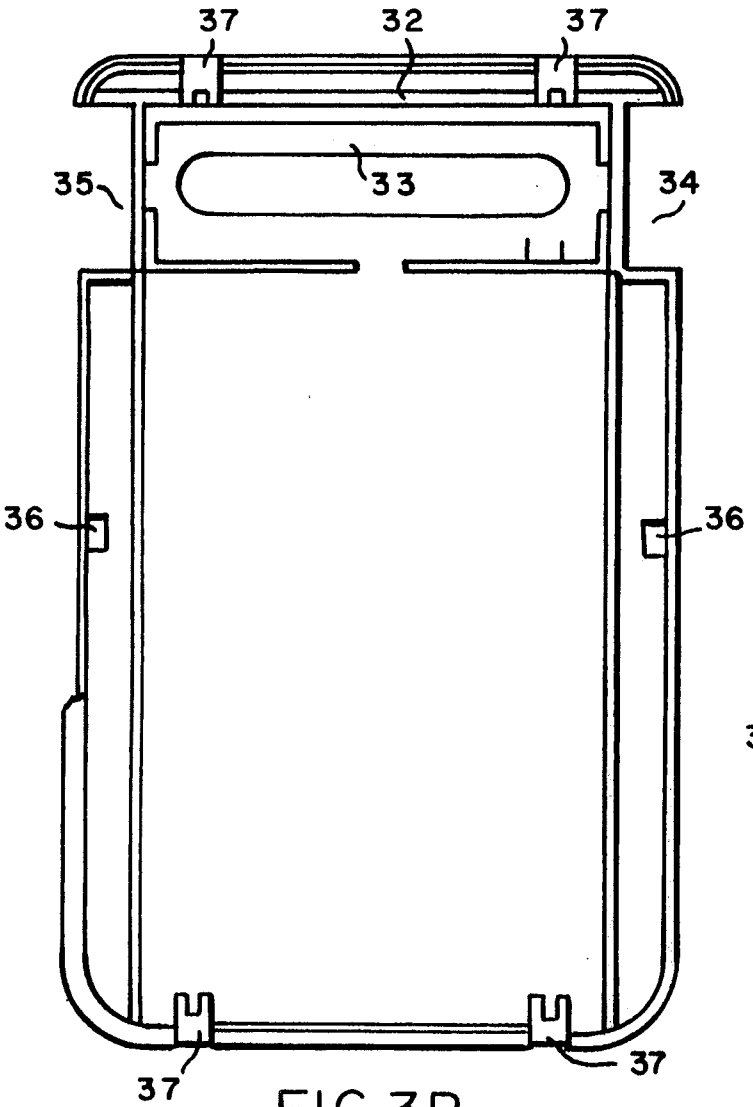

FIGS. 3A–3C show in a more detailed manner the shape of the cover 2, with its rounded areas complementing the rounded areas and the shape of the lower portion 1.

The face 30 of the cover 2 can receive different indications enabling the contents of the box to be identified, preferably redundantly. Thus, the face 30 can receive indications relating to the different staplers which can accommodate the staples present in the box. It is also possible to provide a housing 38 which is well identified by a block 39 which is, for example, coloured to accommodate a reference letter, the block 39 itself being of a reference colour. These reference letters and colours can be identified on an explanatory table associated with the staple box dispenser, to facilitate the identification of the staples when they are being purchased.

Figure 4A:
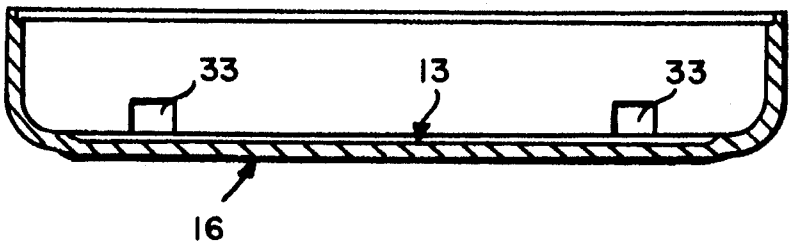
FIGS. 4A, 4B show two cross-sections of the lower part of the box along the lines IVA—IVA and IVB—IVB in FIG. 2A.
Figure 4B:
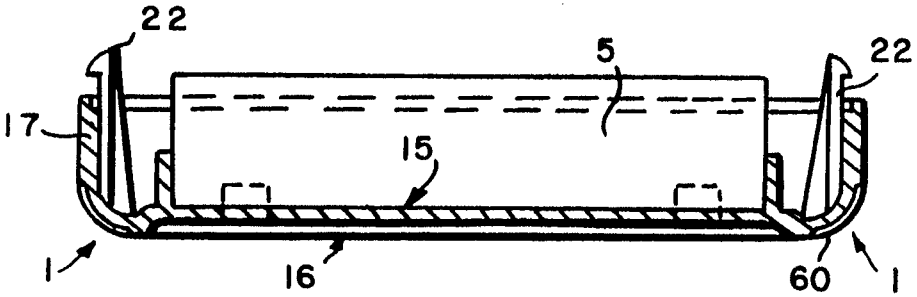
Figure 5A:
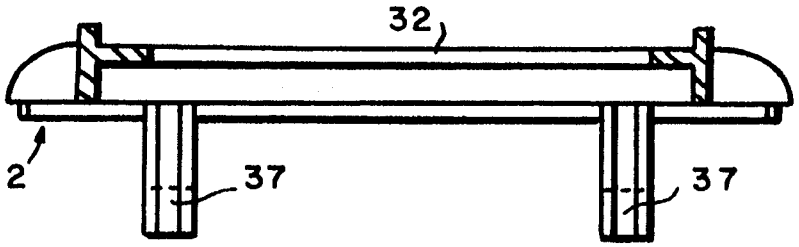
FIGS. 5A, 5B show two cross-sections of the cover along the cutting lines VA—VA and VB—VB in FIG. 3A.
Figure 5B:
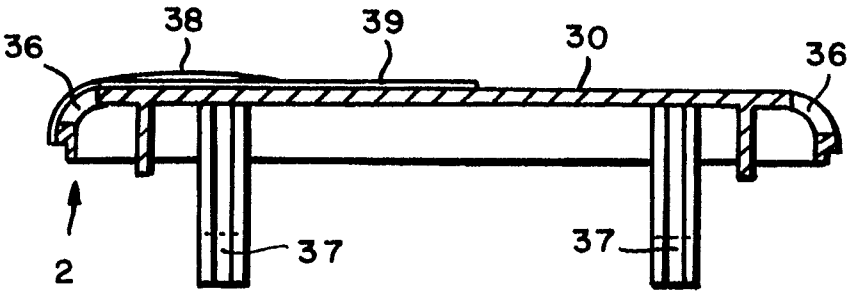
Figure 6C:
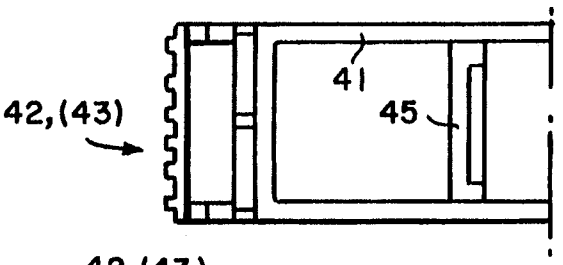
FIGS. 6A, 6B, 6C, 6D, 6E show respectively a half cross-section, a plan view, a view from the lefthand side and a view from the righthand side of the ejector device with a partial cut-out.
Figure 6D:
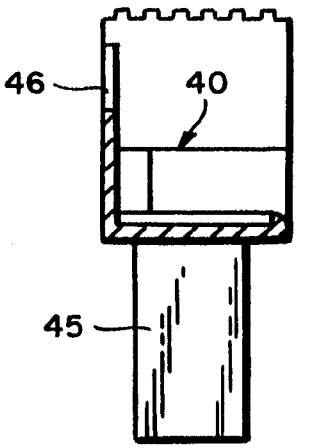
Figure 6A:
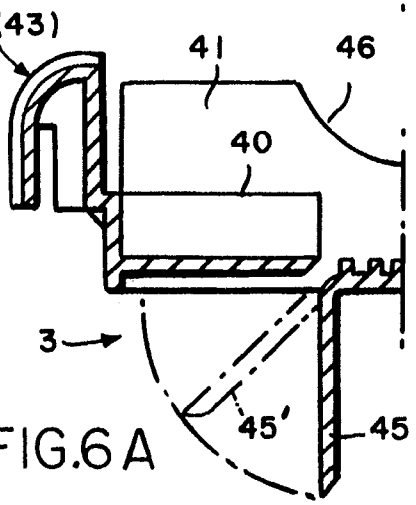
Figure 6B:
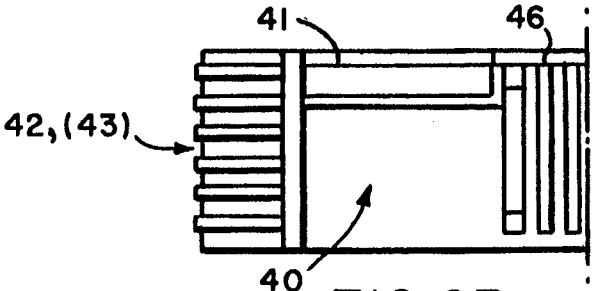
Figure 6E:
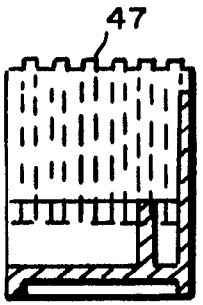

The views in section in FIGS. 4A–4B show more precisely the shape of the lower portion 1, with the base 15 of the magazine 10, the positioning of the stack 24 of strips 5, the shape of the fastening means 22, etc.

The two views in section of the cover 5A, 5B supplementing the views in section in the FIGS. 4A–4B, show the particular shape of the cover 2 with its housings for the passage of the ends of the branches 22 for fastening the lower potion 1 and the shape of the window 32 and of the lugs 37.

The half-views of FIGS. 6A–6E show the particular shape of the ejector device 3 and in particular of the lateral lugs 42, 43 with ribs 47 facilitating the thrust on the lugs 42, 43; these Figures also show an embodiment of the spring 45 formed by lugs which, in the mould-releasing position, are substantially perpendicular to the lower portion of the housing 40 of the ejector 3 (parallel to the direction ZZ). After being positioned, the lugs constituting the spring adopt the position 45' shown by a thin line. It is also possible to produce the lugs forming the spring 45 by moulding them in an inclined position and to alter their resilience in order to remove them from the mould.

Figure 7A:
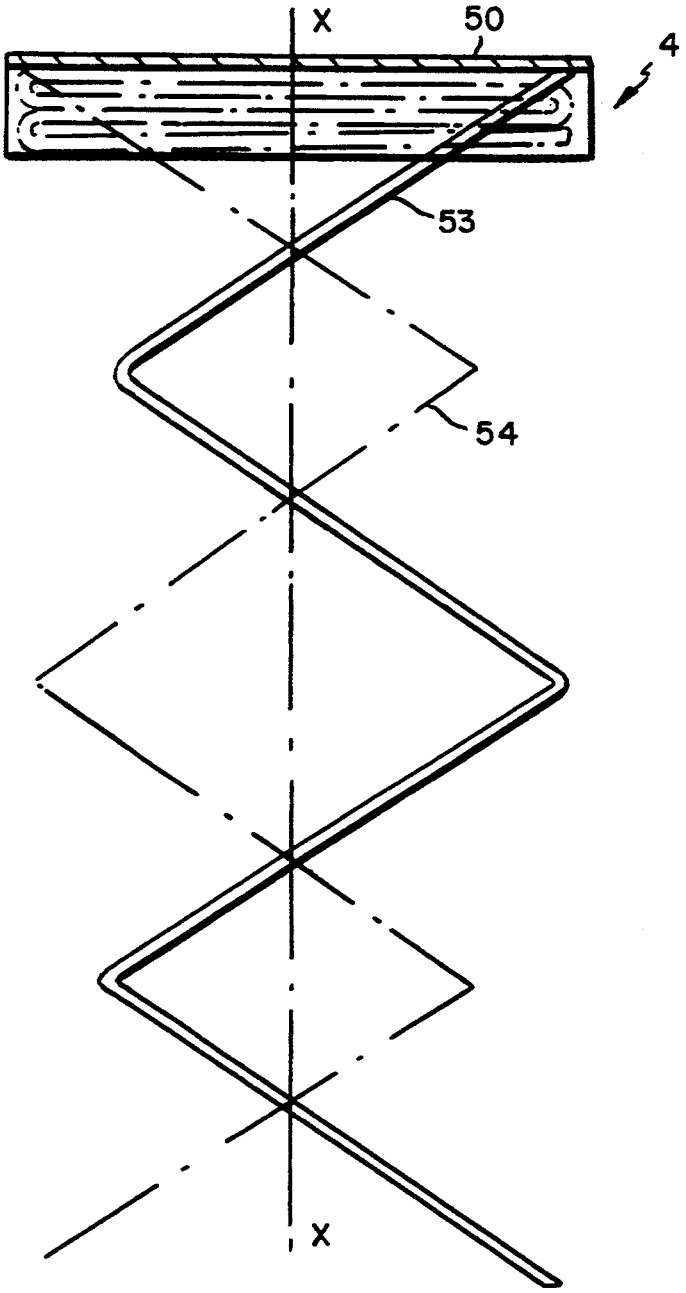
FIGS. 7A, 7B, 7C show respectively a front view of the pusher device and its first spring, the second being sketched in as a broken line.
Figure 7B:
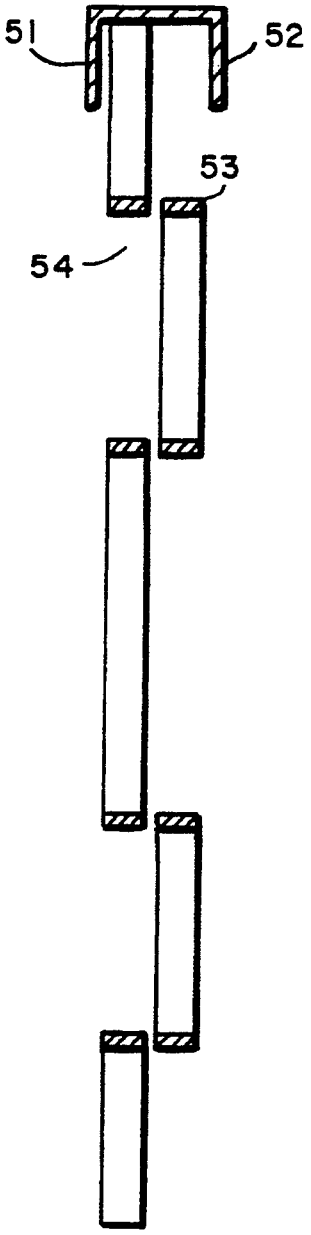
Figure 7C:
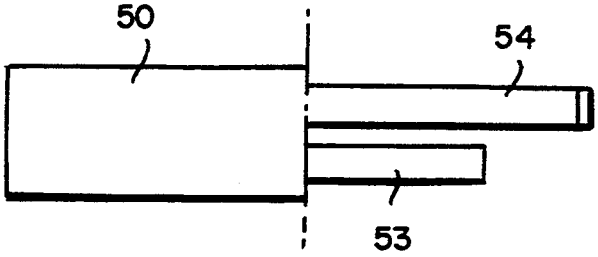

As is shown explicitly in FIGS. 7A–7C, the pusher device 4 consists of a plate 50 intended to bear against the end of the stack of strips. This plate 50 can be bordered at least laterally by an edge 51, 52 to make it easier to retain and guide. The pusher device 4 is provided with a double spring 53, 54 formed by a concertinaed double band. The folding of the spring 53, 54 enables a uniform stress to be exerted in the direction XX (FIG. 7A) identical to the direction XX in FIG. 1.

In the same manner as the other parts of the box, the pusher device 4 is preferably formed in a single part with its springs 53, 54 in the form of a part injected from plastics material.

Figure 8:
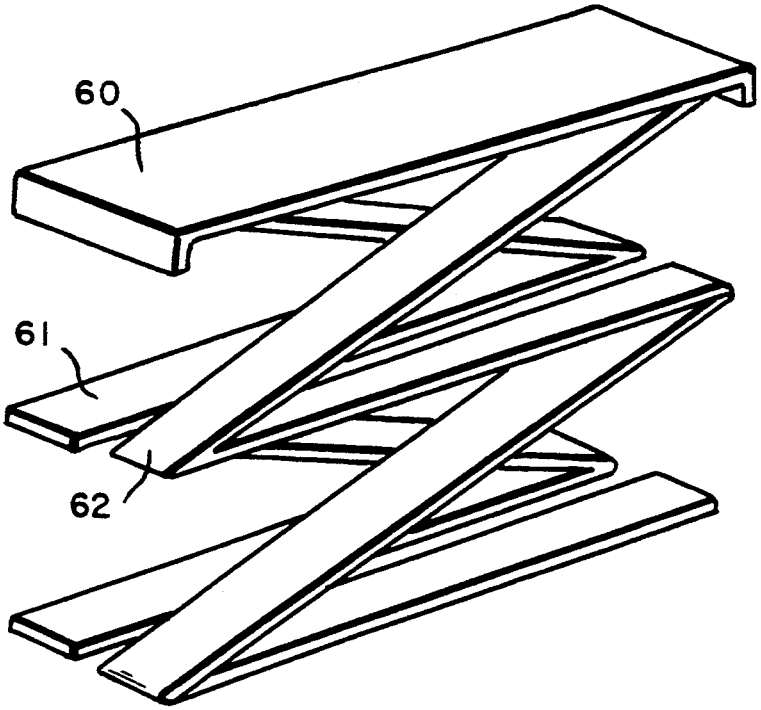
FIG. 8 is a perspective view of an alternative embodiment of the pusher device.

FIG. 8 shows an alternative embodiment of the pusher device with a plate 60 and two springs 61, 62.

FIG. 9A shows a staple 100 with a width L and a height H.

Figure 9B:
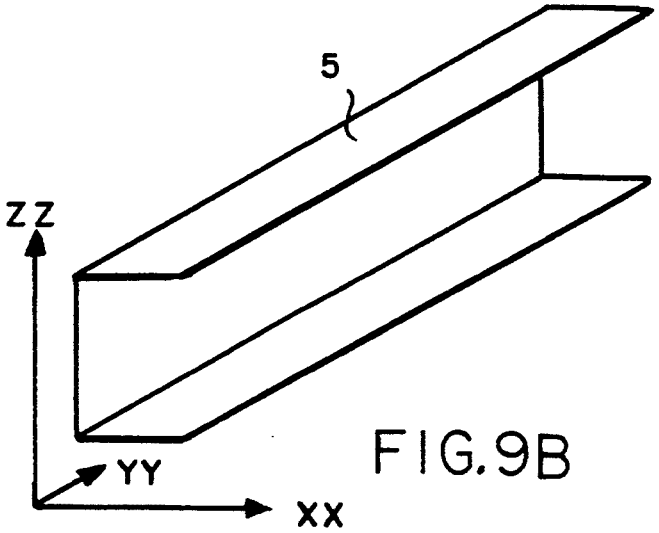

FIG. 9B shows a strip 5 of staples. The staples are rotated through 90°. This Figure also shows a system of axes X, Y, Z corresponding to the system shown in FIG. 1 and showing the orientation of the strip 5 placed in the magazine 10 (not illustrated).

Figure 9C:
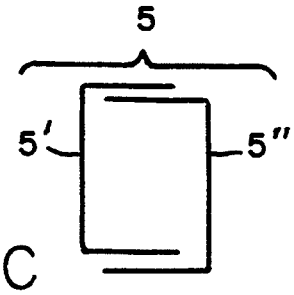

FIG. 9C shows the connection of two strips 5', 5'' forming a double strip 5.

The staples packaged according to the invention can be used in all manual staplers, whether these are electrical or pneumatic. The marks and indications on each box enable the box to be identified both when it is being filled and when it is being purchased.

In addition, since the boxes are practically identical, irrespective of the type of staples, it is advantageous that the width of the box, i.e. the width of the strip housing, is selected such that the length of the strip corresponds to the smallest loader and to half the longest loader. This also corresponds to strips which are less fragile to handle.

I claim:

1. A box for receiving and dispensing staples assembled in strips, the box comprising: a lower portion, said lower portion having a magazine forming a channel for receiving staple strips juxtaposed and parallel to one another in a stack and further positioned transversely to a longitudinal direction of said magazine, said magazine being defined by lateral guides, a base, an ejector device housing at a first end, and a pusher device housing at a second end;

means for advancing progressively a received stack of staple strips towards said ejector device housing as the staple strips are removed;

a cover for covering the lower portion, said cover including a window positioned in alignment with said ejector device housing, said window forming a staple strip ejecting guide means;

a fastening means on the lower portion for fastening the lower portion to said cover;

an ejector device associated with said ejector device housing forming a drawer having a first opening which faces the magazine for receiving a staple strip and a second opening which faces the cover for providing access to a staple strip in the drawer;

said ejector device having staple strip guide means cooperating with said lateral guides and said window, said ejector device being movable between an inserted position and an outlet position, the inserted position enabling a staple strip at the end of a received stack to arrive in the ejector device;

a spring for urging said ejector device from its inserted position to its outlet position; and

2. The box according to claim 1, wherein said window is closed by a movable tamperproof plate which holds said ejector device loaded with a staple strip in said inserted position.

3. The box according to claim 1, wherein said ejector device housing is molded with a height substantially the same as the width of a received staple strip

4. The box according to claim 1, wherein said lower portion of the box has an outer contour which is spaced from said lateral guides defining said magazine.

5. The box according to claim 1, wherein said lower portion has a snap hook.

6. The box according to claim 1, wherein said ejector device has a pair of opposing ends, said ends having supports thereby providing means to push said ejector device into the inserted position.

7. The box according to claim 1, wherein said pusher device has a double spring for exerting a thrust to uniformly move a received stack of staple strips

* * * * *